United States Patent [19]

French

[11] 4,266,826

[45] May 12, 1981

[54] IN-SITU RECOVERY OF CONSTITUENTS FROM FRAGMENTED ORE

[75] Inventor: Gordon B. French, Rifle, Colo.

[73] Assignee: Occidental Oil Shale, Inc., Grand Junction, Colo.

[21] Appl. No.: 689,109

[22] Filed: May 24, 1976

Related U.S. Application Data

[63] Continuation of Ser. No. 505,276, Sep. 12, 1974, abandoned.

[51] Int. Cl.[3] ..... E21B 43/247; E21C 41/10

[52] U.S. Cl. ..... 299/2; 166/259; 166/299; 299/13

[58] Field of Search ..... 299/2, 13; 166/63, 247, 166/256, 259, 299; 102/22, 23; 61/0.5

[56] References Cited

U.S. PATENT DOCUMENTS

| | | | |
|---|---|---|---|
| 1,919,636 | 7/1933 | Karrick | 299/2 |
| 2,609,750 | 9/1952 | McFarland | 102/23 |
| 3,295,445 | 1/1967 | Ball et al. | 102/23 |
| 3,316,020 | 4/1967 | Bergstrom | 299/2 |
| 3,466,094 | 9/1969 | Haworth et al. | 299/13 |
| 3,593,789 | 7/1971 | Prats | 166/259 |
| 3,611,933 | 10/1971 | Lanning | 102/23 |
| 3,627,044 | 12/1971 | Dunlap | 166/259 X |
| 3,794,116 | 2/1974 | Higgins | 166/259 |
| 3,951,456 | 4/1976 | Ridley | 299/2 |
| 3,980,339 | 9/1976 | Heald et al. | 299/2 |
| 4,181,361 | 1/1980 | Ridley et al. | 299/2 |

*Primary Examiner*—Stephen J. Novosad
*Assistant Examiner*—George A. Suchfield
*Attorney, Agent, or Firm*—Christie, Parker & Hale

[57] ABSTRACT

A fragmented recovery zone in a subterranean ore seam has a polygonal cross section with a low void volume and a conical funnel-shaped bottom with a high void volume. Recovered constituents are removed from the recovery zone at the point of convergence of the funnel.

15 Claims, 4 Drawing Figures

IN-SITU RECOVERY OF CONSTITUENTS FROM FRAGMENTED ORE

This is a continuation of application Ser. No. 505,276, filed Sept. 12, 1974, now abandoned.

BACKGROUND OF THE INVENTION

This invention relates to the recovery of constituents from subterranean ore deposits and, more particularly, to an in-situ method of recovery that is particularly effective in the production of shale oil.

One known technique for recovering shale oil is to set up an in-situ retort in a subterranean oil shale deposit. The shale within a recovery zone is fragmented, the shale at the top of the recovery zone is ignited, and air is supplied to the top of the recovery zone to sustain combustion, which proceeds slowly down through the fragmented shale in the recovery zone. As burning proceeds, the heat of combustion is transferred to the shale below the burning front to release the shale oil and gases therefrom by a retorting process. Thus, a horizontal retorting front moves from top to bottom of the recovery zone in advance of the burning front, and the resultant shale oil and gases pass to the bottom of the recovery zone for collection.

It is important that the gas flow through the recovery zone is uniform. If the gas flow is uneven, i.e., more gas flows downward through certain paths than through other paths, the retorting front may become skewed. The carbonaceous values released in the lagging region of the retorting front may be oxidized in the leading region of the burning front, thereby reducing the yield of the process.

SUMMARY OF THE INVENTION

According to the invention, a recovery zone comprising a permeable fragmented mass of ore has a downwardly converging bottom. Constituents released from the ore are collected at the point of convergence of the bottom. Preferably, the recovery zone has a polygonal horizontal cross section with a low void volume and a funnel-shaped bottom with a high void volume. The bottom serves to deliver released constituents to a single exit for collection and to promote uniform gas flow through the recovery zone.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
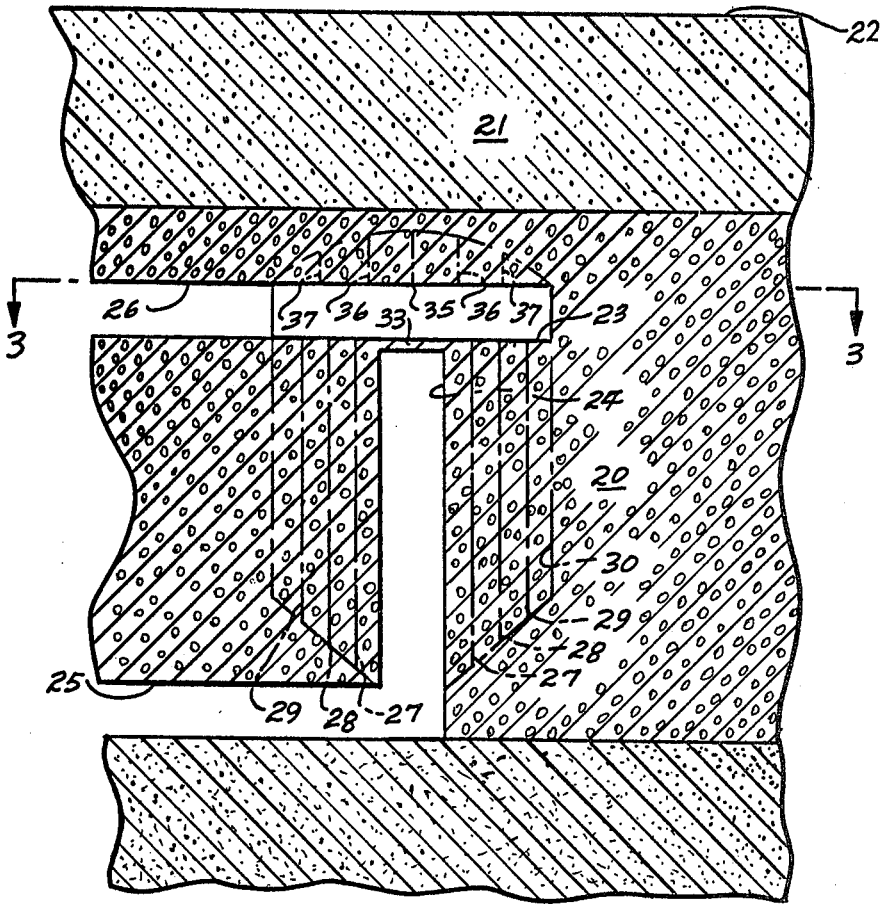
FIG. 1 is a side sectional view of a portion of a subterranean oil shale seam prior to formation of a recovery zone.
Figure 2:
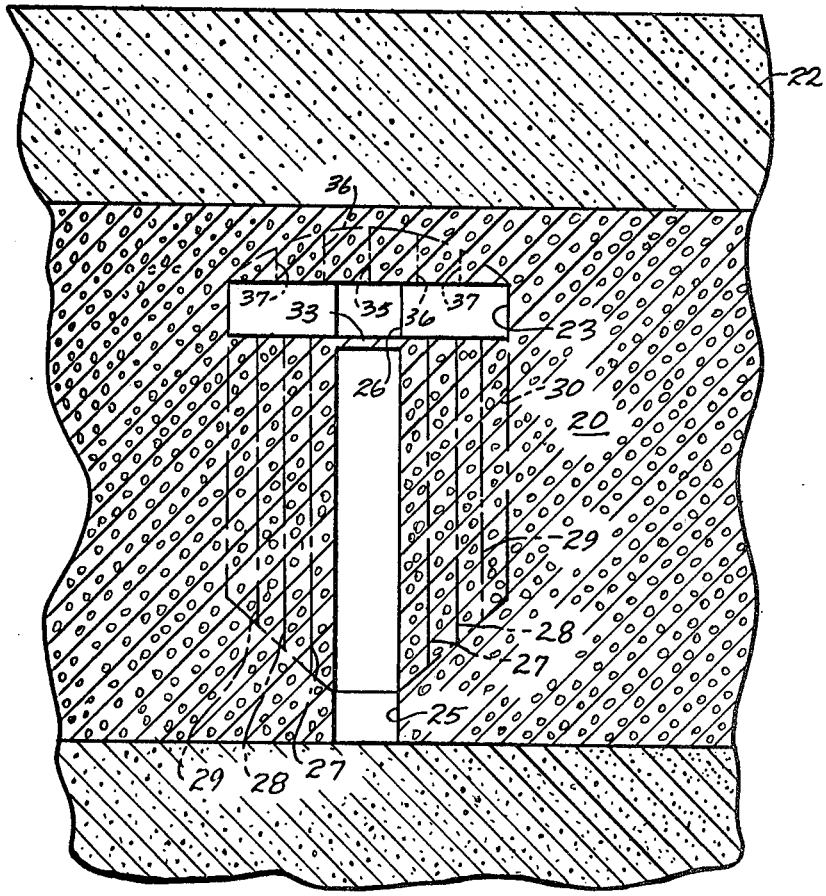
FIG. 2 is a front sectional view of the seam of FIG. 1.
Figure 3:
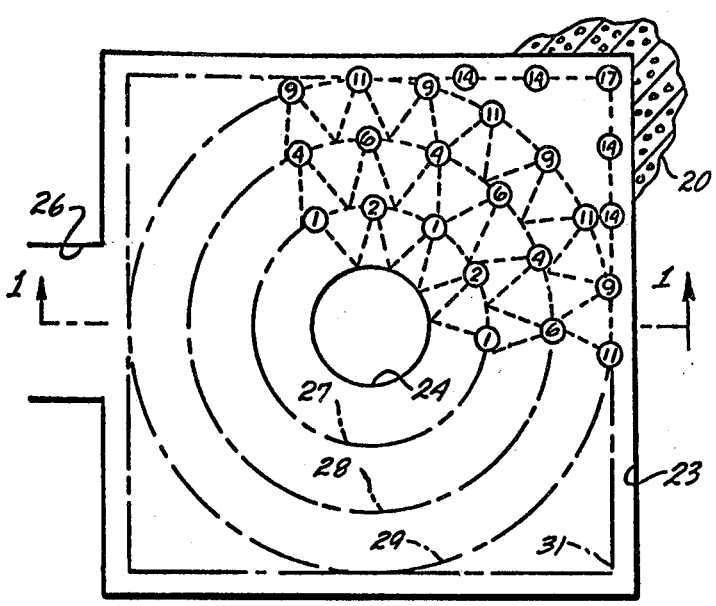
FIG. 3 is a top sectional view of the seam of FIG. 1.

Reference is made to FIGS. 1, 2, and 3, which depict a horizontal subterranean oil shale seam 20, an overburden 21, and ground level at 22. To prepare seam 20 for in-situ recovery of shale oil, a horizontal room 23, a vertical raise 24, and a tunnel 25 are formed therein. Room 23, which has a square floor plan, i.e., horizontal cross section, lies near the top of seam 20, and raise 24, which is a hollow cylindrical column having a constant diameter over its entire length, extends from the floor of room 23 at the intersection of the diagonals of the floor plan to tunnel 25, which extends along the bottom of seam 20. If desired, raise 24 could be a non-cylindrical, e.g., square, column. The term "seam" as used herein means the portion of an ore deposit to be worked; thus, a seam may comprise either the entire depth of a deposit or only a portion thereof. A tunnel 26 and a shaft, not shown, connect room 23 to ground level. Tunnel 25 is also connected to ground level by a shaft, not shown. Room 23, raise 24, and tunnels 25 and 26 are formed by conventional mining techniques. The necessary pillars to support the roof of room 23 are formed from shale left in place during mining. The height of room 23, which is substantially smaller than the dimensions of its floor plan, is dictated by the space required to work seam 20 in the manner described below. Tunnels 25 and 26 are preferably self-supporting, i.e., narrow enough that their roofs do not subside in the absence of support pillars. In one working embodiment, room 23 was 30 feet high, 100 feet long, and 100 feet wide; raise 24 was 48 feet in diameter and 250 feet in height; and tunnels 25 and 26 were 30 feet high and 30 feet wide.

Raise 24 could be formed in one of the two ways disclosed in copending application Ser. No. 505,457, filed Sept. 12, 1974, by Gordon B. French, entitled METHOD OF FRAGMENTING ORE FOR IN SITU RECOVERY OF CONSTITUENTS, now abandoned. The top of raise 24 terminates short of room 23. The shale left between raise 24 and room 23 forms a pillar 33 which leaves the floor of room 23 free from a hazardous condition, namely, a large opening, during the operations subsequently conducted therefrom. The debris created during formation of raise 24 is transported through tunnel 25 to ground level.

The shale in a recovery zone 30, represented in FIG. 1 by phantom lines, is to be fragmented for the purpose of recovering shale oil therefrom by an in-situ retorting operation. The volume of recovery zone 30 is defined approximately by the area of the floor plan of room 23 and the height of raise 24. The recovery zone has long vertical sides, a top, and a bottom. The objectives of the fragmentation are to maximize the permeability and minimize the void volume of the fragmented shale. A high permeability is desired in order to transmit gases through the recovery zone without an undue pressure drop, i.e., power consumption. A small void volume is desired to minimize the mined shale, which is expensive to remove, and maximize the retorted shale, which increase the yield of shale oil. Uniformity of the permeability in a horizontal plane, hereafter called horizontally uniform permeability is also an objective, because it prevents channeling in the flow of gases through the recovery zone. Channeling impairs the effectiveness of the recovery process.

The void volume of the fragmented shale depends upon the ratio of the cross-sectional area of raise 24 to the horizontal cross-sectional area of recovery zone 30, which is approximately the same as the area of the floor plan of room 23. Thus, to control the void volume, one selects the diameter for raise 24. It has been found that there is a minimum value of void volume beyond which the permeability of the fragmented shale increases sharply. Below the minimum value of void volume, the shale fractures without fragmenting. In other words, fissures are formed but the shale freezes in place, so to speak; it does not actually break up and move appreciably. Above the minimum value of void volume, the shale moves appreciably and breaks up into individual fragments, thereby creating high permeability. In the preferred embodiment of the invention, the shale surrounding raise 24 in recovery zone 30 is explosively expanded in a plurality of concentric annular layers moving outwardly in rapid sequence; each layer is completely severed from the adjoining shale to form a free face prior to the severance of the next layer. In one experiment in which the cross-sectional area of raise 24 was approximately 18% of the horizontal cross-sectional area of recovery zone 30, the horizontal cross section of recovery zone 30 was about 1000 square feet, and the vertical height of recovery zone 30 was about 80 feet, it was found that the shale fragmented well throughout and 1 psi of pressure was required to achieve an approximately horizontally uniform gas flow rate of 1200 scfm from top to bottom of the recovery zone. Generally, the void volume should be large enough to cause a pressure drop of less than 5 psi through the recovery zone with horizontally uniform permeability. Although the minimum void volume consistent with this requirement has not been experimentally verified, it is believed to be approximately 8%, i.e., raise 24 should have a cross-sectional area that is greater than approximately 8% of the horizontal cross-sectional area of recovery zone 30. If the void volume is too small, the outer layers of shale do not have enough room to expand, so they fracture instead of fragmenting; as a result, horizontally uniform permeability is not achieved and the explosives used for the outer layers of shale are not effectively utilized. If the void volume is too large, needless expense is incurred to mine the shale. Therefore, to achieve the most favorable balance between high, horizontally uniform permeability and void volume, the cross-sectional area of raise 24 is preferably between 8% and 18% of the cross-sectional area of recovery zone 30. In any case, if the void volume exceeds approximately 40%, the fragmented shale fails to fill completely the space within recovery zone 30 and, therefore, does not offer support for overburden 21. For this reason, 40% is usually an upper limit on the void volume, although the mining expense becomes prohibitive far below 40%.

To prepare the region around raise 24 for explosive expansion, concentric rings 27, 28, and 29 of vertical blasting holes are drilled downwardly from room 23 along the length of raise 24. Although three rings are shown, more would be required for the dimensions of the working embodiment. A closed square border 31 of vertical blasting holes covers the corners of the region to be fragmented. Border 31 defines the horizontal cross-sectional area of recovery zone 30. In practice, it is not possible to drill border 31 precisely along the edges of room 23, so the horizontal cross-sectional dimensions of recovery zone 30, e.g., 97 feet by 97 feet, will be slightly smaller than the dimensions of room 23, e.g., 100 feet by 100 feet. It has been found that the shale will fracture without fragmenting if the distance from the blasting holes to the free surface toward which the shale is expanding, hereafter called the blasting distance, exceeds a certain limiting value. In the case of ring 27, the blasting distance extends from ring 27 to the free surface of raise 24; in the case of ring 28, the blasting distance extends from ring 28 to the free surface created at ring 27; and in the case of ring 29, the blasting distance extends from ring 29 to the free surface created at ring 28. To a certain extent, the limit on blasting distance depends upon the diameter of the blasting holes. For example, if the diameter of the blasting holes is 3 inches, the limit is approximately 10 feet; if the diameter of the blasting holes is 6 inches, the limit is approximately 15 feet; if the diameter of the blasting holes is larger than 6 inches, the limit does not increase appreciably beyond 15 feet. The blasting holes are distributed so the sides of the imaginary triangles formed between adjacent holes in each ring and an intermediate point on the free surface toward which the ring is expanded, i.e., an adjacent ring, represented in FIG. 3 by dashed lines, do not exceed the limit on the blasting distance. Thus, the number of rings and the number of blasting holes in each ring depend upon the cross-sectional area of recovery zone 30 and the diameter of the blasting holes.

Recovery zone 30 is to be provided with a dome-shaped top. Accordingly, a blasting hole 35 and concentric rings of blasting holes 36 and 37 are drilled upwardly from room 23. The lengths of these blasting holes vary in accordance with the desired dome shape. The volume of shale included within the dome-shaped top of recovery zone 30 above room 23 is sufficiently large that after explosive expansion of the shale, fragmented shale completely fills the volume within the dome, thereby providing support for overburden 21. To reduce the volume of shale expanded above room 23, a portion of the rubble removed in the course of the formation of room 23 could be returned thereto prior to explosive expansion.

The entire length of the blasting holes are loaded from room 23 with an explosive charge such as dynamite or ammonium nitrate mixed with fuel oil. In the latter case, there is about 6 net tons of shale per pound of explosive. Room 23 and tunnel 24 are sealed off by a barrier, pillar 33 is explosively fragmented, and the charge in the blasting holes is detonated in the following sequence of steps:

(a) ring 26
(b) ring 27
(c) ring 28
(d) border 31, with the exception of the corner holes
(e) the corner holes of border 31
(f) hole 35 and rings 36 and 37 simultaneously Thus, the shale adjacent to raise 24 is explosively expanded into raise 24 and to some extent into room 23 into concentric rings moving outwardly from raise 24. On the one hand, the time delay between each of the above steps is sufficiently large, e.g., 100 to 150 milliseconds, to permit the layer of shale created by detonating each ring to completely break away from the remaining shale surrounding it, thereby creating a new free face prior to the detonation of the next ring of blasting holes. This insures that the shale does not fracture without fragmenting. On the other hand, the time delay between each of the above steps is not so large that the layers of shale fall appreciably before the blasting sequence is completed. This insures good horizontal uniformity of the permeability within recovery zone 30. In summary, the delay between the steps of the sequence is such that the shale surrounding raise 24 expands inwardly in discrete layers to fill the available space substantially without expanding appreciably in a downward direction.

Within each ring there is a small delay, e.g., 50 to 100 milliseconds between detonation of alternate holes to cause the shale to break up vertically in the vicinity of the holes. This provides better fragmentation.

The detonators for the blasting holes are provided with delay fuses that are triggered simultaneously. The numbers of these delay fuses are indicated in FIG. 2 inside the respective blasting holes. As measured from the instant of triggering the fuses, the following correspondence between fuse numbers and time delays exists:

| Fuse Number | Time Delay |
|---|---|
| No. 1 | 25 milliseconds |
| No. 2 | 50 milliseconds |
| No. 4 | 100 milliseconds |
| No. 6 | 170 milliseconds |
| No. 9 | 280 milliseconds |
| No. 11 | 320 milliseconds |
| No. 14 | 500 milliseconds |
| No. 17 | 700 milliseconds |

According to the invention, recovery zone 30 has a funnel-shaped bottom with a higher void volume than the remainder of recovery zone 30. In other words, the bottom of recovery zone 30 has an inverted, right conical surface with a base that meets the vertical sides of recovery zone 30 and a point of convergence at tunnel 25. The funnel-shaped bottom can be formed in one of two ways.

The first way is to drill vertical blasting holes that have different lengths and to form the fragmented shale in the bottom of recovery zone 30, at the same time the remainder of recovery zone 30 is fragmented. Thus, the blasting holes of rings 27, 28, and 29, and border 31, respectively, are incrementally shorter in length than raise 24 so as to provide the desired slope on the bottom of recovery zone 30. The ratio of the cross-sectional area of raise 24 to the horizontal cross-sectional area of recovery zone 30 and, thus, the void volume of the fragmented shale, increases at the bottom of recovery zone 30 because the horizontal cross-sectional area of recovery zone 30 decreases. If desired, the bottom of raise 24 could be tapered to provide a higher, constant ratio.

The second way is to mine out a funnel-shaped cavity and then backfill the cavity with fragmented shale prior to explosively expanding the shale in recovery zone 30 above the funnel-shaped backfilled region. This could be done by forming an access tunnel where the conical surface of the bottom meets the vertical side surfaces. Backfilled shale naturally has a void volume of about 40%.

Figure 4:
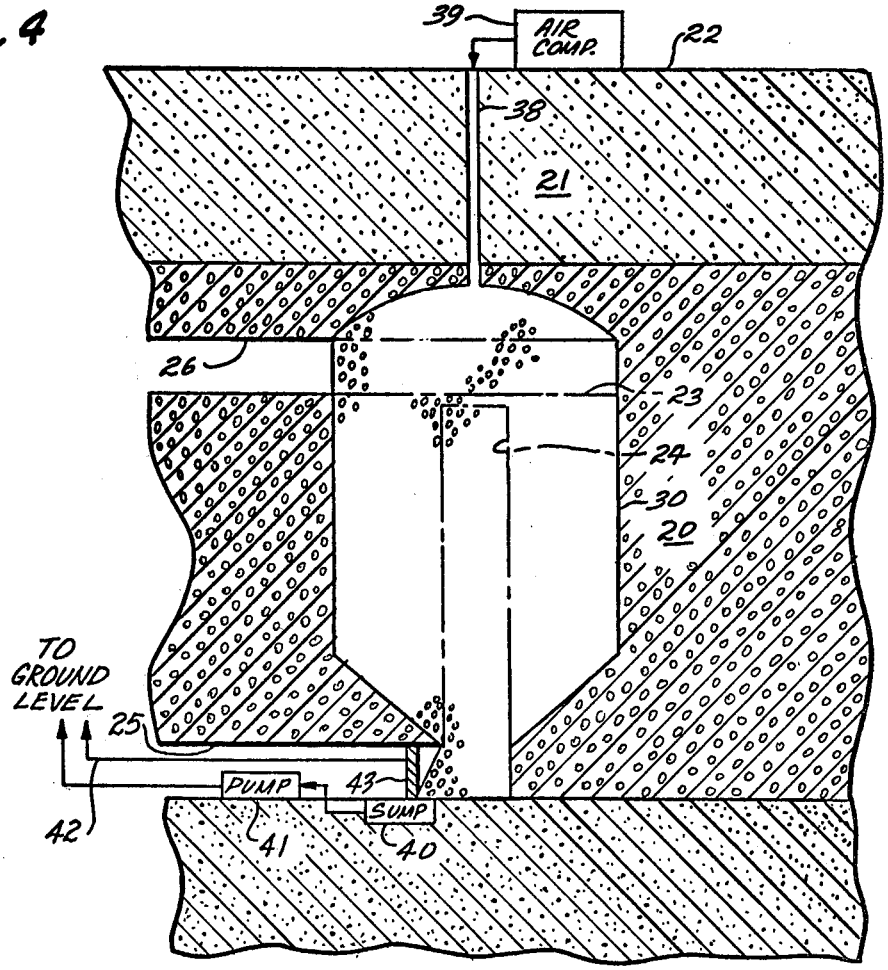
FIG. 4 is a side sectional view of the seam of FIG. 1 after formation of the recovery zone.

Reference is made to FIG. 4, which depicts seam 20 after fragmentation of the shale within recovery zone 30. Recovery zone 30 has a polygonal, specifically square, horizontal cross section, which permits most efficient fragmentation of most shale deposits. The permeability and void volume of the fragmented shale within recovery zone 30 have substantial horizontal uniformity. Although the void volume varies from top to bottom of recovery zone 30, i.e., between horizontal planes, this does not impair the effectiveness of the retorting process. The region between room 23 and the funnel-shaped bottom of recovery zone 30 has a voild volume of approximately 18%, i.e., a void volume determined by the ratio of the cross-sectional area of raise 24 to the horizontal cross-sectional area of recovery zone 30. The funnel-shaped region at the bottom of recovery zone 30 and the dome-shaped region including room 23 at the top of recovery zone 30 have a void volume larger than 18%. Preferably, the void volume in the funnel-shaped region at the bottom of recovery zone 30 is btween about 30% and 40%. The former locations of room 23 and raise 24 are shown by phantom lines.

A conduit 38 connects an air compressor 39 located at ground level 22 to the uppermost point of recovery zone 30. Because of the high permeability of the fragmented shale, compressor 39 must only deliver air at about 5 psi or less, which does not require very much power. As described in U.S. Pat. No. 3,661,423, the disclosure of which is incorporated herein by reference, the shale at the top of recovery zone 30 is ignited, compressor 39 supplies air for maintaining combustion, and the fragmented shale burns slowly downward in a horizontal front. Carbonaceous values comprising liquid shale oil and flue gases are released by the heat of combustion in a retorting process. The shale oil percolates downward to the bottom of recovery zone 30 in advance of the burning front, and the flue gases are forced to the bottom of recovery zone 30 by the pressure of the air introduced at the top of recovery zone 30. Shale oil collects in a sump 49, which is located at the low point of tunnel 25. Tunnel 25 is exposed to the fragmented shale at the point of convergence of the funnel-shaped bottom of recovery zone 30, which shape serves two functions. The first function is to direct all the shale oil and flue gases to a single exit point for collection. The second function is to improve the horizontal uniformity of the gas flow through recovery zone 30 by virtue of the higher void volume and the converging retort walls, because the gas gradually compresses as it flows downwardly to occupy the entire horizontal cross section at the bottom of recovery zone 30. Depending upon the slope of tunnel 25, special grading and/or drainage ditches may need to be provided prior to the explosive expansion in order to drain the shale oil to sump 40. A pump 41 carries the shale oil from sump 40 to ground level. A conduit 42 carries the flue gases recovered from the retorting process from a sealed bulkhead 43 in tunnel 25 to ground level.

The described embodiment of the invention is only considered to be preferred and illustrative of the inventive concepts; the scope of the invention is not to be restricted to such embodiment. Various and numerous other arrangements may be devised by one skilled in the art without departing from the spirit and scope of this invention. For example, the shale within recovery zone 30 could be fragmented by techniques other than that disclosed.

What is claimed is:

1. An in-situ retort in an oil shale deposit comprising:

an elongated recovery zone extending along a vertical axis in the deposit comprising a fragmented permeable mass of particles containing oil shale, the recovery zone having a top, a bottom, and vertical sides extending between the top and bottom, the fragmented mass adjacent to the bottom having a larger void volume than the remainder of the fragmented mass;

a source of a gas capable of releasing shale oil upon exposure to the fragmented mass in the recovery zone;

means for coupling the source to the top of the recovery zone to release the shale oil from the fragmented mass within the recovery zone; and means for removing the released shale oil from the bottom of the recovery zone; and wherein the bottom of the recovery zone has a surface that converges downwardly from the vertical sides to a point of convergence, and the removing means removes the released shale oil from the point of convergence.

2. The retort of claim 1, in which the surface of the bottom defines an inverted right cone having a base meeting with the vertical sides and an apex at the point of convergence.

3. The retort of claim 2, in which the vertical sides have a polygonal horizontal cross section.

4. The retort of claim 3, in which the polygonal horizontal cross section is rectangular.

5. The retort of claim 4, in which the void volume of the portion of the fragmented mass adjacent the bottom is between 30% and 40% and the void volume of the remainder of the fragmented mass is less than 20%.

6. A method for forming an in situ oil shale retort containing a fragmented permeable mass of particles containing oil shale in an oil shale deposit comprising the steps of:

establishing communication with a given level of the deposit;

removing oil shale at the given level to form a room having a floor plan corresponding to the horizontal cross section of the retort;

drilling down from the room a plurality of substantially vertical blasting holes corresponding to the depth of the retort below the room, the blasting holes drilled from one area of the room being longer than the blasting holes drilled from the remainder of the room, and the blasting holes drilled from the remainder of the room being at least two different lengths and arranged so that they are gradually shorter moving away from the one area to define an intact bottom boundary that slopes to a low area at the bottom of the blasting holes drilled from the one area of the room;

loading the blasting holes with an explosive charge;

detonating the explosive charge to form the retort containing the fragmented permeable mass and having an intact bottom boundary that slopes to the low area; and providing means adjacent the low area for recovering shale oil from the retort.

7. The method of claim 6, in which the one area is at the center of the room and the blasting holes drilled from the remainder of the room decrease gradually in length outwardly from the center of the room.

8. The method of claim 7, in which a vertical raise is formed below the center of the room prior to detonating the charge in the blasting holes and the blasting holes are arranged in concentric rings around the raise, the detonating step comprising detonating the rings of blasting holes sequentially in an outward direction.

9. The method of claim 8, in which the raise has a substantially constant diameter over its entire length.

10. The method of claim 6, in which a vertical raise is formed below the center of the room prior to detonating the charge in the blasting holes and the blasting holes are arranged in concentric rings around the raise, the detonating step comprising detonating the rings of blasting holes sequentially in an outward direction.

11. A method for recovering a constituent from an ore deposit comprising the steps of:

establishing communication with a given level of the deposit;

removing ore at the given level to form a hollow region that defines the bottom portion of a recovery zone;

back filling the region with the removed ore in fragmented form to provide a high void volume bottom portion;

explosively expanding the ore above the bottom portion to form as the remaining portion of the recovery zone a permeable fragmented mass of lower void volume than the bottom portion;

introducing into the top of the recovery zone a recovery fluid to release from the ore a constituent; and removing the constituent from the bottom of the recovery zone.

12. The method of claim 11, in which the ore is oil shale, the constituent is shale oil, and the recovery fluid is air, the method comprising the additional step of igniting the shale at the top of the recovery zone to establish a horizontal retorting front moving from the top toward the bottom of the recovery zone.

13. The method of claim 11, in which the hollow region is funnel-shaped.

14. A method for recovering shale oil from an in situ oil shale retort in a subterranean deposit containing oil shale comprising the steps of:

excavating deposit from within boundaries of an in situ oil shale retort being formed in a subterranean deposit to form a hollow region adjacent at least the bottom portion of an in situ oil shale retort being formed;

backfilling at least a portion of the hollow region with fragmented deposit to provide a high void volume bottom portion;

explosively expanding deposit containing oil shale within boundaries of the in situ oil shale retort being formed above the bottom portion to form a fragmented permeable mass in an in situ oil shale retort, the fragmented permeable mass having a lower void volume than the backfilled bottom portion;

introducing a recovery fluid into the top of the fragmented mass in the in situ oil shale retort for retorting oil shale therein for producing shale oil; and withdrawing shale oil from the bottom of the in situ oil shale retort.

15. The method of claim 14 in which the bottom of the in situ oil shale retort is funnel-shaped.

* * * * *